US011180226B2

(12) United States Patent
Jensen et al.

(10) Patent No.: US 11,180,226 B2
(45) Date of Patent: Nov. 23, 2021

(54) MARINE BATTERY DRIVEN MOTOR

(71) Applicant: Thrustme AS, Stavanger (NO)

(72) Inventors: Kjartan Jensen, Hundvåg (NO); Kjetil Fedde, Hafrsfjord (NO)

(73) Assignee: Thrustme AS, Stavanger (NO)

( * ) Notice: Subject to any disclaimer, the term of this patent is extended or adjusted under 35 U.S.C. 154(b) by 0 days.

(21) Appl. No.: 16/772,989

(22) PCT Filed: Dec. 18, 2018

(86) PCT No.: PCT/NO2018/050318
§ 371 (c)(1),
(2) Date: Jun. 15, 2020

(87) PCT Pub. No.: WO2019/125177
PCT Pub. Date: Jun. 27, 2019

(65) Prior Publication Data

US 2020/0391831 A1 Dec. 17, 2020

(30) Foreign Application Priority Data

Dec. 22, 2017 (NO) ..... 20172031
Dec. 12, 2018 (NO) ..... 20181591

(51) Int. Cl.

| | |
|---|---|
| ***B63B 34/10*** | (2020.01) |
| ***B63H 5/20*** | (2006.01) |
| ***B63H 21/17*** | (2006.01) |
| ***B63H 21/21*** | (2006.01) |

(52) U.S. Cl.
CPC ..... *B63B 34/10* (2020.02); *B63H 5/20* (2013.01); *B63H 21/17* (2013.01); *B63H 21/21* (2013.01); *B63H 2021/216* (2013.01)

(58) Field of Classification Search
CPC ..... B63B 34/10; B63H 5/20; B63H 21/21; B63H 21/17; B63H 2021/216
See application file for complete search history.

(56) References Cited

U.S. PATENT DOCUMENTS

| | | | | |
|---|---|---|---|---|
| 6,132,267 | A | 10/2000 | Campbell | |
| 9,836,048 | B1 | 12/2017 | Widmaier | |
| 2014/0336927 | A1 | 11/2014 | Ellis et al. | |
| 2014/0364020 | A1 | 12/2014 | Stone et al. | |
| 2015/0294660 | A1* | 10/2015 | Stokes | G01S 15/86 367/173 |
| 2015/0298782 | A1 | 10/2015 | Bemloehr et al. | |

(Continued)

FOREIGN PATENT DOCUMENTS

| | | | |
|---|---|---|---|
| EP | 2147854 | A1 | 1/2010 |
| WO | 2016/145537 | A1 | 9/2016 |

OTHER PUBLICATIONS

Norwegian Search Report for Application No. 20172031, dated Jun. 6, 2018 in 2 pages.

(Continued)

*Primary Examiner* — Stephen P Avila
(74) *Attorney, Agent, or Firm* — Knobbe, Martens, Olson & Bear, LLP

(57) ABSTRACT

Motor assembly for providing propulsion of a floating vessel, comprising: motor device (23), mounting means (24, 32) for attaching the motor device (23) to the floating vessel, the motor device (23) comprising an electrical motor (4) and a propeller (5) arrange inside a propeller house (3).

18 Claims, 12 Drawing Sheets

(56) References Cited

U.S. PATENT DOCUMENTS

2016/0325815 A1 11/2016 Nikmanesh
2018/0106619 A1* 4/2018 Johnson ..... G01C 25/005

OTHER PUBLICATIONS

Norwegian Search Report for Application No. 20181591, dated Jun. 14, 2019 in 2 pages.
Supplementary European Search Report issued for European Patent Application No. EP18890766, dated Sep. 10, 2021 in 2 pages.

* cited by examiner

MARINE BATTERY DRIVEN MOTOR

CROSS-REFERENCE TO RELATED APPLICATIONS

This application is the U.S. National Phase under 35. U.S.C. § 371 of International Application PCT/NO2018/050318, filed Dec. 18, 2018, which claims priority to Norwegian Patent Application No. 20172031, filed Dec. 22, 2017 and Norwegian Patent Application No. 20181591, filed Dec. 12, 2018. The disclosures of the above-described applications are hereby incorporated by reference in their entirety.

FIELD OF THE INVENTION

The present invention relates to a device for propulsion of a floating vessel, and in particular a kayak. The invention relates further to an arrangement and system for communication between one or more devices of the invention and a remote facility.

BACKGROUND

Boats and marine vessels often comprise motors for propulsion and thrust, in order to move the vessel over a distance of water.

Electrical powered motors have been introduced in order to provide a more environment friendly approach to transport on water.

For ships and recreational boats this is often non problematic since boats normally are designed for comprising propulsion, and space allow storing of battery packs.

However, it is a problem to use any of the available motors on a kayak or canoe; mostly because there is no place to arrange such motors, but also because a motor will greatly reduce the navigability of the vessel due to the necessary depth a propeller must be arranged to achieve sufficient thrust.

Maximum thrust is achieved when a propeller is arranged centrally below a keel of a floating vessel, and this adds a further problem when trying to arrange motors on kayaks and canoes.

SUMMARY OF THE INVENTION

It is a goal for the present invention to provide an electrical motor and arrangement of such, usable for propulsion of a floating vessel, and in particular for a kayak or canoe, wherein the present invention shall solve some or all of the problems discussed above.

It is further a goal for the present invention to provide a system for handling emergency situations when being on a kayak or canoe hike, and the system may provide communication and guidance for rescue operations.

In one further embodiment of the invention it is provided a feature wherein the motor can be remotely controlled by a remote controller.

It shall be understood that the embodiments only describe the principle of the invention, and that there may be additional ways to implement the present invention, or features may be combined in different ways than in the specific embodiments described. It is the associated claims that shall define the protection scope of the present invention.

Additional features and advantages of the present disclosure are described in, and will be apparent from, the following brief description of the drawings and the more detailed description of the embodiments

DETAILED DESCRIPTION OF THE PREFERRED EMBODIMENTS

Figure 1:
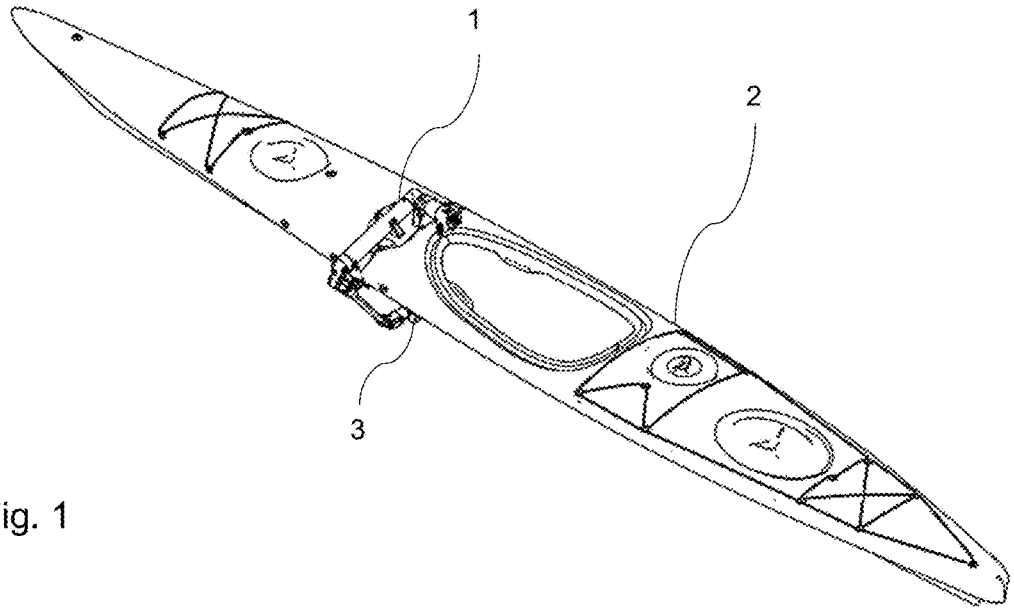
FIG. 1—motor assembly attached to a kayak

The following word and phrases are used in this document, and shall if not otherwise described have the following meaning:

Kayak and or canoe: it is assumed that both kayak and canoes have very similar design and use, and in this document both vessel types shall be included if any of those words are used.

The following description may use terms such as "horizontal", "vertical", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 illustrates a motor assembly 1 mounted on a kayak 2. The motor assembly 1 could also be mounted on e.g. a canoe, a stand up paddle board, dinghy or any similar marine vessel. In FIG. 1, the propeller housing 3 of the motor assembly 1 is in an active position, i.e. the propeller housing 3 is positioned below the kayak 2. This is also described further in detail with reference to FIG. 5. The motor assembly 1 is explained in detail in the following description.

Figure 2A:
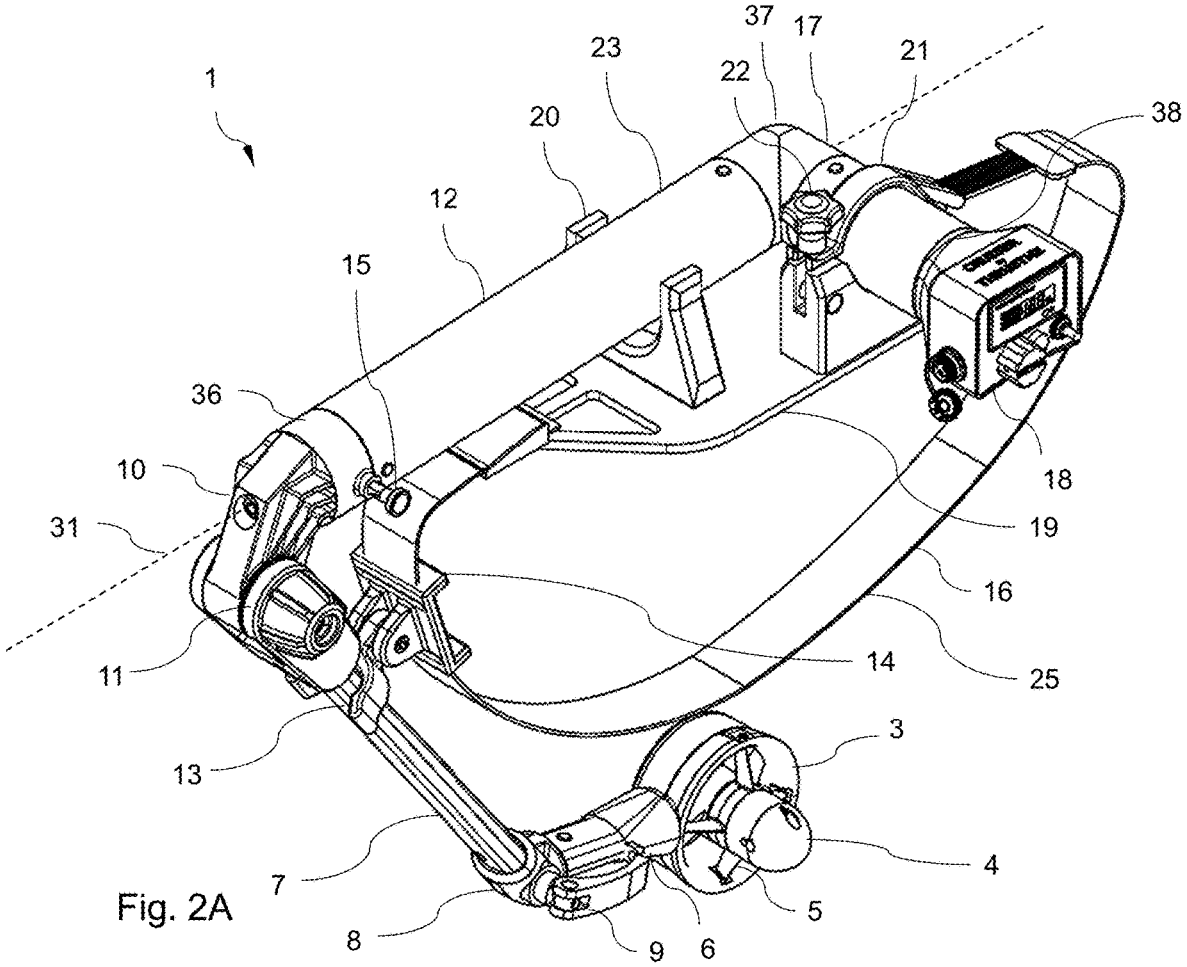
FIG. 2A—motor assembly, mounting bracket and support belt, oblique view

FIG. 2A illustrates the motor assembly 1 isolated, i.e. not mounted on a kayak or similar vessel, with the propeller housing 3 in the active position. The propeller housing 3 comprises an electrical motor 4 adapted to rotate propellers 5. The electrical motor 4 is provided in a water tight configuration with sealed through holes (not shown) for wiring providing power from battery and/or remote power source, and optional control signaling.

The propeller housing 3 also comprises a propeller housing arm 6 that may be rotatable connected in a propeller housing pivot connection point 8 to a rotatable arm 7 at a distal end. The propeller housing pivot connection point 8 can be locked in various positions by a lock handle 9. The propeller housing pivot connection point 8 can lock and release a pivotal connection by moving the lock handle 9 between a locking position and a release position. Other means for locking the rotatable connection 8 may be utilized.

The rotatable arm 7 and the propeller housing arm 6 have preferably a foil like or oval cross section, such as to minimize water pull/resistance while being submerged. The rotatable arm 7 is rotatable connected in a linkage arm pivot connection point 11 at the other distal end to a linkage arm 10. Linkage arm pivot connection point 11 may comprise a knob that provides a locking function between the rotatable arm 7 and the linkage arm 10. By rotating the knob the linkage arm pivot connection point 11 can be tightened in a locking engagement or loosened to unlock the engagement. The linkage arm 10 may be pivotal connected to a battery and controlling unit 12, 17, 18 at another distal end. The linkage arm 10 may be pivotal about an axis 31 which is generally parallel with the longitudinal axis of a battery housing 12 in the battery and controlling unit 12, 17, 18. A linkage arm lock knob 15 may be provided to control a pin which is retracted from a corresponding locking hole when the linkage arm lock knob 15 is pulled, such that the linkage arm 10 is free to pivot about the battery housing axis when the linkage arm lock knob 15 is pulled. Typically, there can be two locking holes which the pin can penetrate, one hole which locks the propeller housing 3 in an active position, and one locking hole which locks the propeller housing 3 in an inactive position. The linkage arm lock knob 15 may be spring-mounted such that the pin will automatically enter a locking hole when the rotatable arm 7 is rotated to the predefined position. A pivotal battery housing connection sleeve part 36 between the linkage arm 10 and the battery and controlling unit 12, 17, 18 may be configured such that the rotatable arm 7 may be rotated in one specific direction from the inactive position to the active position, and may thus be reversibly rotated from the active position to the inactive position only.

Figure 11A:
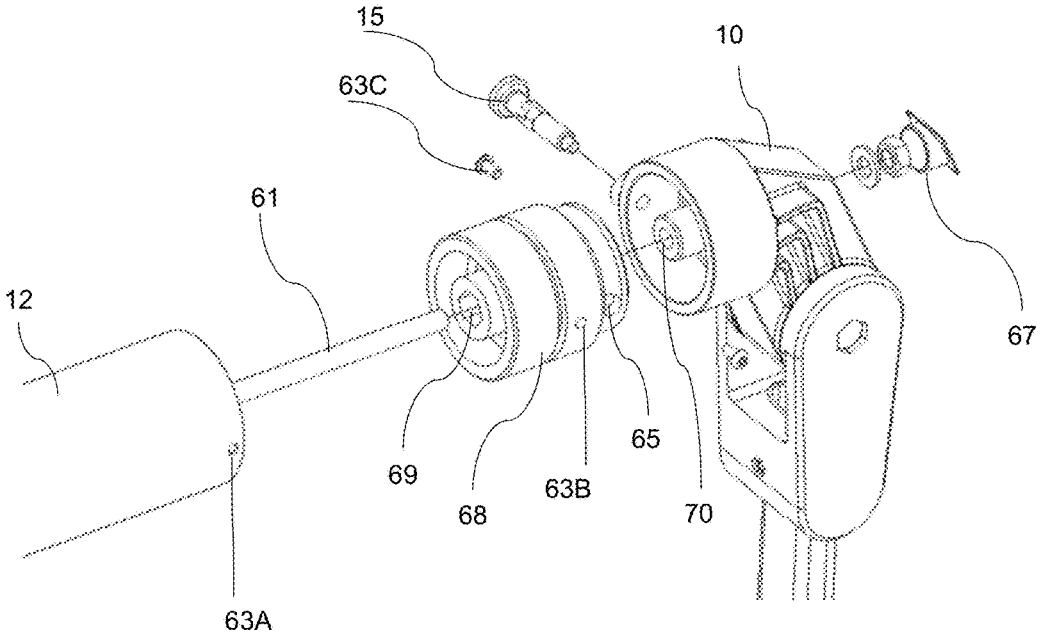
Figure 11B:
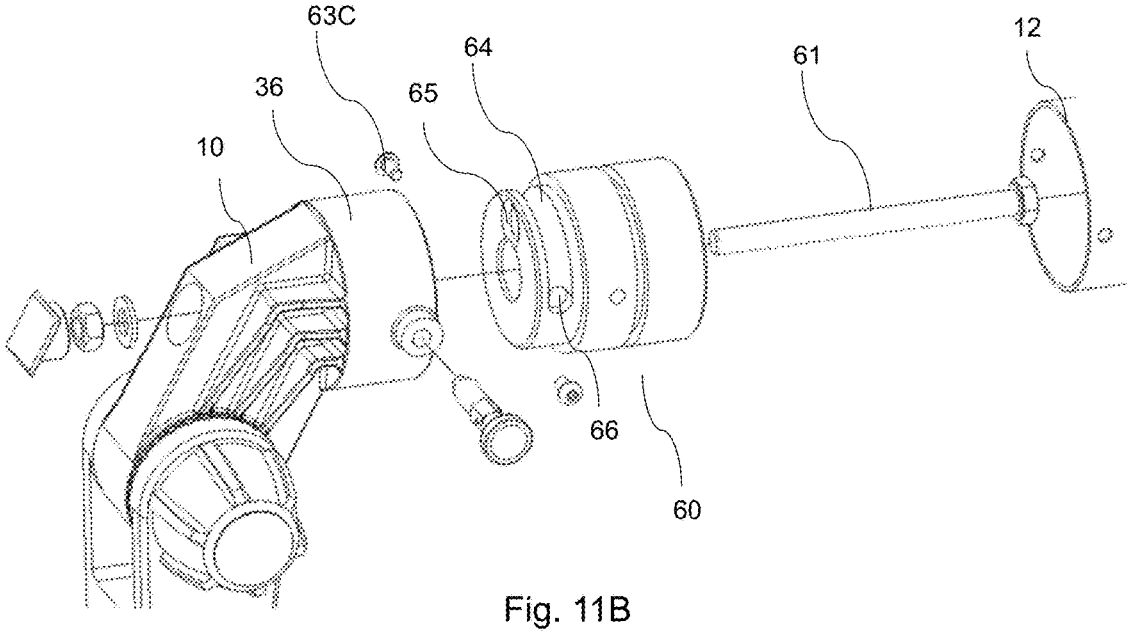

The pivotal battery housing connection 36 may in one embodiment as illustrated in FIGS. 11A and 11B be comprising a rotating piston 68 having a first through-hole for receiving a pivot axle/bolt 61 and a second through-hole 65 for threading of wiring (not shown). The piston 60 is in a first end 68 arranged inside the first end of the battery housing 12, and fastened with fastening means 63C being threaded through corresponding holes 63A and 63*b*. This fastening means may be substituted by soldering, screw, glue or similar. The piston is further mounted together with the linkage arm 10 by threading the axle 61 through the hole 69 in the piston 60, and into a corresponding recess or through a hole 70 of the linkage arm. The recess 70 may have threads corresponding to threads on end of the axle 61, or the recess is a through-hole and fastened by nut assembly 67 or equivalent. The second end of the piston 60 may comprise a partly circumventing groove 64. The second end is arranged inside the sleeve part 36 of the linkage arm 10. The sleeve part 36 of the linkage arm 10 is provided with a fastening arrangement for the linkage arm lock knob 15. The groove may comprise a deeper section 65, 66 in one or both ends of the groove for receiving a correspondingly formed tip of the linkage arm lock knob 15. It is then possible to have a pivotal connection having fixed locked position at both extreme rotations of the linkage arm 10. Typically the length of the groove 64 is arranged to allow a pivotal distance of the linkage arm from an active position when propeller is arranged under the vessel (see FIG. 1), to an inactive position of the when propeller is arranged in a resting position out of the water (see FIG. 8).

Wiring for power and control signals are provided between and through all relevant parts of the motor assembly 1. Water tight through-holes 65 may be provided to allow wiring between water tight and non-water tight parts of the motor assembly.

Figure 7:
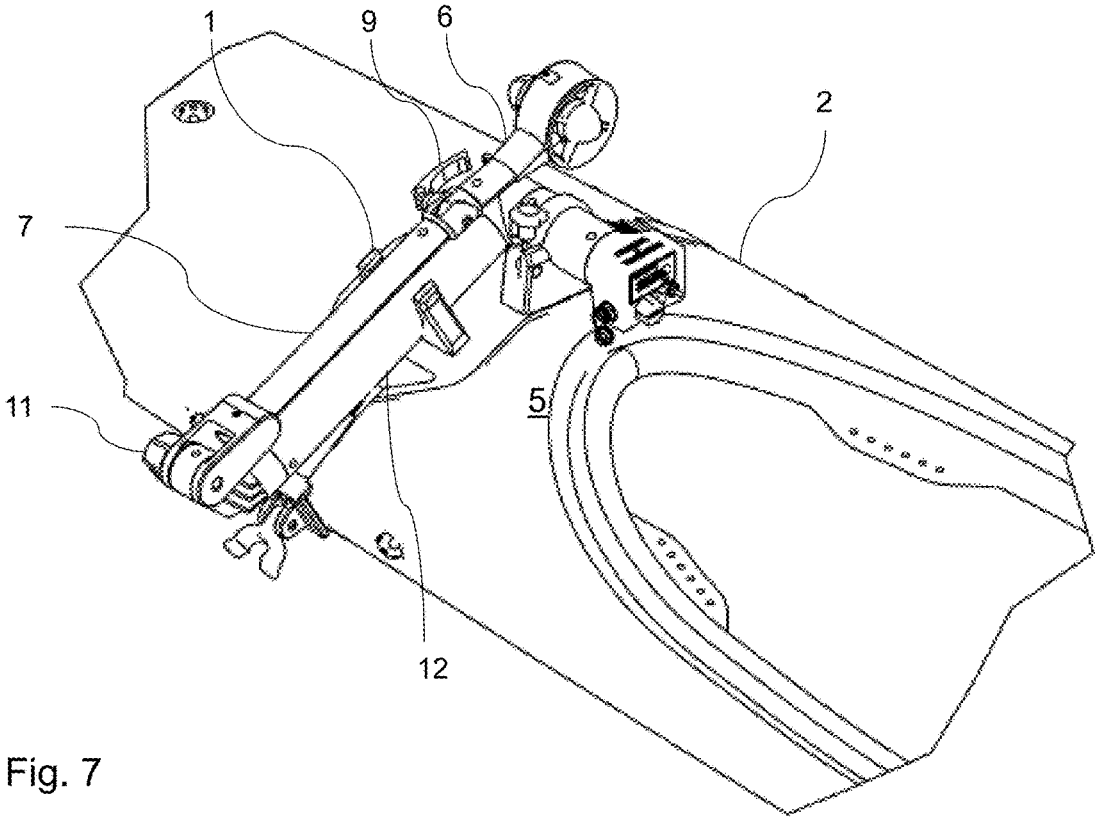

The rotatable arm 7 can pivot around the linkage arm pivot connection point 11 in the connection to the linkage arm 10. The knob may be configured to lock the rotation of the rotatable arm 7 in this pivot point. Together, the rotatable and pivotal connections provide for a motor assembly with a propeller housing 3 which can be moved back and forth between an active position as illustrated in FIG. 1 and an inactive position as illustrated in FIG. 7.

When in the active position, the rotatable arm 7 can be securely positioned by means of a resilient snap-connection 13. The snap-connection 13 is configured for releasable holding the rotatable arm 7 in a firm grip when the rotatable arm 7 is forced into the snap-connection 13. The snap-connection 13 may be hinge-connected to a snap-connection base 14, which is arranged on a support belt 16. The support belt 16 is adapted to span around the hull of the kayak, and as such provides for a secure, releasable fastening of the motor assembly 1 to vessels having various cross-sections. The support belt 16 is described in further detail with reference to FIG. 4. When the support belt 16 is tightened around a hull of a vessel, the snap-connection base 14 is biased towards the hull, and the snap-connection base 14 is rigidly positioned on the support belt 16 and on the side of the hull of the vessel. The snap-connection 13 thus holds the rotatable arm 7 firmly in place under normal working conditions. However, the snap-connection may be designed to have some flexibility, such that when an obstacle is hit by the propeller house or rotatable arm, the snap-connection 13 may release its grip on the rotatable arm, and thus minimize damages to the motor assembly 1. The flexibility may be provided by resilience in the material of one or more of the snap-connection 13, the snap-connection belt 14, or the support belt 16.

Figure 12A:
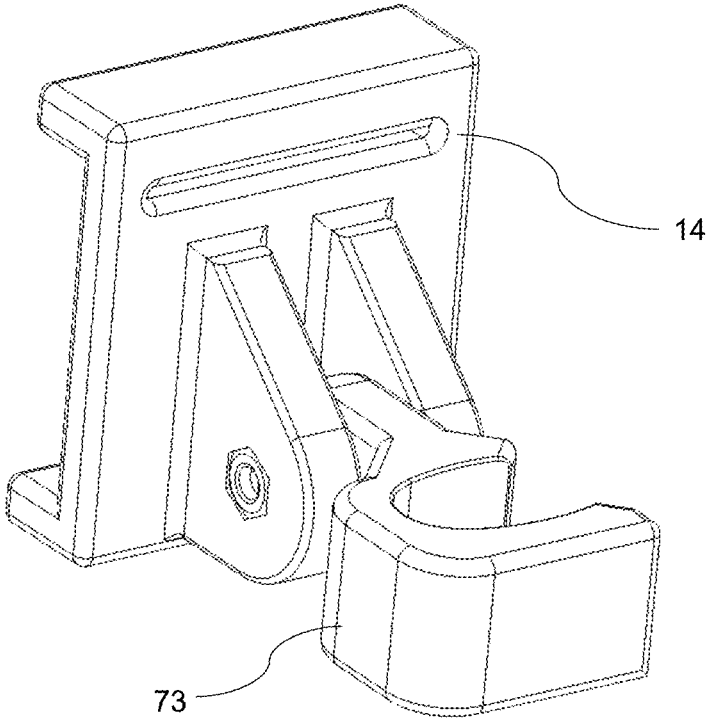
Figure 12B:
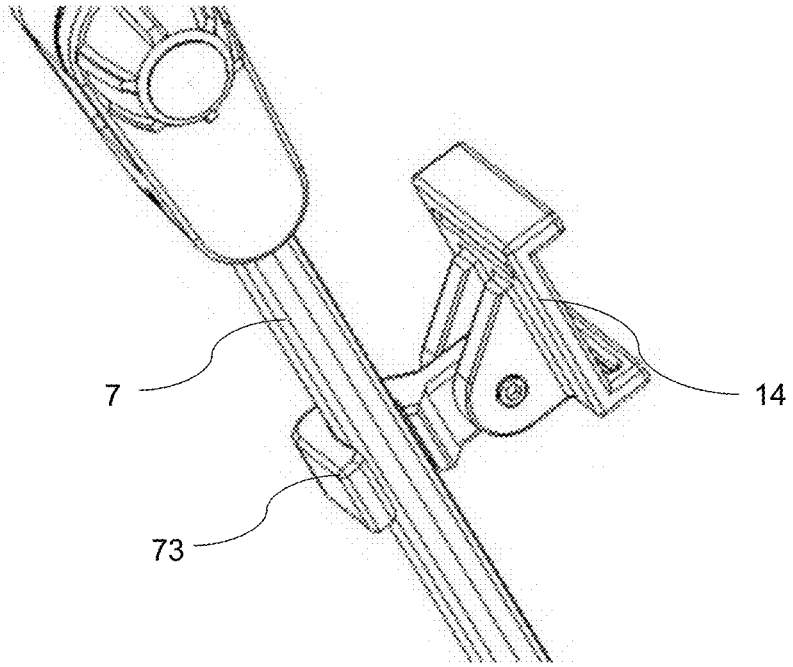

An alternative embodiment of the snap-connection is shown in the backward open connector 73 shown in FIGS. 12A and 12B. The backward open connector 73 may or may not comprise a resilient snap lock feature. If the propeller driving the vessel forward the rotatable arm 7 will be pushed into the open connector 73, and the backward open connector 73 will exert a firm grip on the rotatable arm 7. This connection will even provide an easier release if the propeller house collides with obstacles under active phase. For safety reasons, a protective mesh 41, 42 may be provided fastened on the propeller housing 3 outside the propeller 5 on either side of the propeller 5, to protect the propeller 5 from inflicting damage on persons or animals.

The battery and controlling unit 12, 17, 18 may be provided in separate battery housing 12, a controller shaft 17 and controller unit 18. To improve flexibility a controller shaft connection point 37 between battery housing 12 and controller shaft 17, and/or a controller unit connection point 38 between controller shaft 17 and controller unit 18 may be an angled and/or pivotal connection point.

Figure 3:
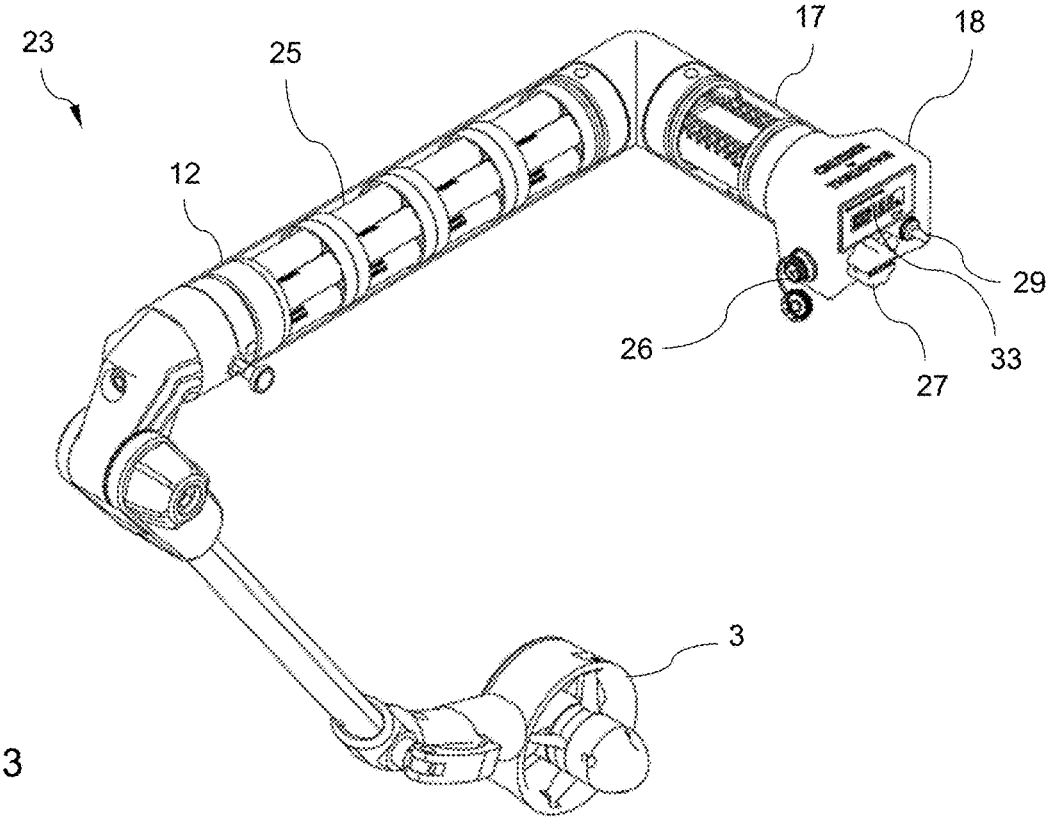

The battery housing 12 may comprise a power source, such as chargeable batteries, which powers the motor assembly 1 and motor 4 in particular; this is described more in detail with reference to FIG. 3. In one distal end, the battery housing 12 is connected to a controller shaft 17. In the shown embodiment, the controller shaft 17 is a generally 90° angled shaft, connecting the battery housing 12 to a control unit 18. The 90° shaft provides for a control unit 18 which is angled towards a user of the control unit, i.e. a person sitting in the kayak, when the motor assembly 1 is mounted on the kayak in front of the user. In a further embodiment, the control unit 18 may be mounted directly to the battery housing, or any other part of the motor assembly 1. The control unit 18 is described in further detail with reference to FIG. 3.

The connection between the battery housing 12 and the controller shaft 17 or the connection between the controller shaft 17 and control unit 18 may also be a rotatable connection, for example as described above in the rotatable connection between the linkage arm 10 and the battery housing 12, and thereby facilitating an option to arrange the motor on opposite side of the vessel.

The arrangement of the pivotal connectors in the above embodiments may be arranged differently to provide additional firmness to the positions, or to provide folding into and out of in-active position in alternative ways (not shown). For example the battery housing 12, the controller shaft 17 and the control unit (18) can be combined in a fixed housing assembly.

FIGS. 1 and 2A defines the motor assembly 1 comprising a motor device 23 and mounting means 24 typically for attachment of motor device 23 to a kayak. The attachment means 24, 32 may be adapted individually for the form and type of vessel to which the motor device 23 it to be attached to. A different type of vessel is discussed in FIGS. 9, 10A and 10B.

Figure 4:
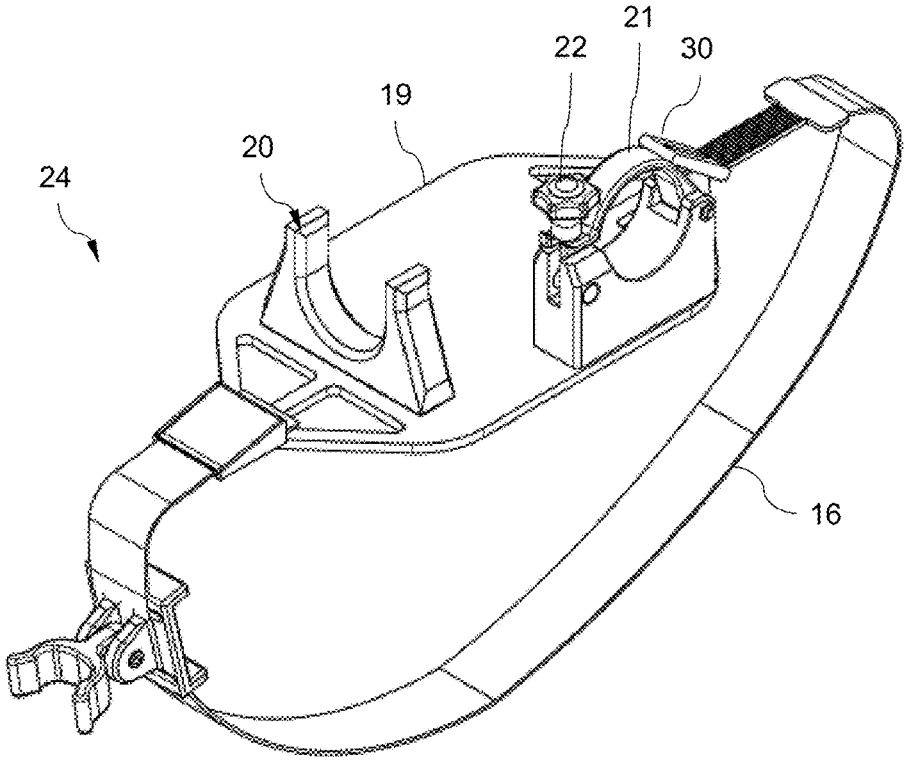

The support belt 16 is connected at two ends to a mounting bracket 19 as seen in FIG. 4. The support belt 16 and mounting bracket 19 can thus form a closed loop, adapted to be tightened around a hull of a vessel, as outlined above. The mounting bracket 19 is adapted to be placed on an upper side of the kayak, and provides stability to the motor assembly 1. When the support belt 16 is securely tightened around the kayak, the mounting bracket 19 is biased towards the kayak, and provides a rigid base for the motor assembly 1. The mounting bracket 19 comprises a support 20, adapted to receive the battery housing 12. In the illustrated embodiment the support 20 is U-shaped to allow easy entering.

A clamp 21 is configured to secure the controller shaft 17 to the mounting bracket 19. A clamp knob 22 is configured to tighten an upper clamp part to a lower clamp part and thus rigidly fix the controller shaft 17, or any other part configured to be inserted into the clamp, to the mounting bracket 19.

The propeller housing 3, propeller housing arm 6, rotatable arm 7, linkage arm 10, battery housing 12, controller shaft 17, control unit 18 and associated parts form a motor unit 23. The motor unit 23 is shown and described further with reference to FIG. 3. The support belt 16, snap-connection 13, mounting bracket 19 and associated parts form a bracket unit 24, which is shown and described further with reference to FIG. 4.

FIG. 3 illustrates the motor unit 23 isolated, i.e. not mounted on the bracket unit 24. In FIG. 3, the battery housing 12 is visualized without an outer casing for illustrating purposes, such that batteries 25 are visible. Preferably, the motor assembly 1 is powered from batteries. In one embodiment, the batteries can be of the rechargeable type, and can also be replaceable, such that spare batteries can be brought and replaced e.g. while out at sea. Batteries may be assembled in a battery frame providing easy pluggable contact interfaces (not shown) for quick lock/release connections (not shown) inside the battery housing 12. The controller shaft 17 is also illustrated without an outer casing such that internal components are visible. The internal components provide connection and computing and communication for example between the control unit 18 with the batteries 25 and the propeller housing 3. The control unit 18 and/or the internal components may further provide communication means providing communication with remote communication resources, such as cloud services or emergency services.

A display unit 33 may be provided in the control unit 18 for displaying information such as power status of batteries, speed of vessel, temperature air/water, map coordinates, map, power usage rate, connectivity to remote services, or other. The display unit 33 may be touch sensitive, and controller/switch features may be incorporated and selected from the interactive touch screen.

The control unit 18 may comprise a charge port 26 which can be used for recharging the batteries 25. The charge port 26 may be provided with a cap or similar means in order to make it water tight, or substantially prevent water from entering into the charge port 26 when not in use. As a skilled person would appreciate, the charge port could be positioned basically anywhere on the motor unit 23. The control unit 18 also comprises at least one input knob/switch 27, where a user can regulate power settings, choose between different information to be displayed on the display 33, etc.

In a further embodiment of the motor unit 18, the batteries may be omitted, and the motor unit 18 may be powered by a separate battery resource connected to the motor 4 through wiring connected to the charge port 26.

The control unit may further comprise an audio device (not shown) for outputting audio signals, or for receiving audio commands/communication. For example a service such as conversation with remote services may be provided.

The control unit 26 also comprises a power switch 29 for switching the motor unit 23 on and off. The power switch 29 could also be connected to a user by means of a wire or similar means, such that if the user by accident is moved away from the kayak, the power switch 29 is turned off, and the motor unit 23 will immediately stop running.

In one embodiment, the controller unit 18, the controller shaft 17, and the battery housing 12 is a water tight construction, so that the motor unit 23 is fully capable of being submerged in water. If it is accidentally dropped into water it will thus not be damaged. The motor unit 23 can be mounted on both the starboard and port side of a vessel.

An alternative embodiment of the snap-connection is shown in the backward open connector 73 shown in FIGS. 12A and 12B. The backward open connector 73 may or may not comprise a resilient snap lock feature. If the propeller driving the vessel forward the rotatable arm 7 will be pushed into the open connector 73, and the backward open connector 73 will exert a firm grip on the rotatable arm 7. This connection will even provide an easier release if the propeller house collides with obstacles under active phase. For safety reasons, a protective mesh 41, 42 may be provided fastened on the propeller housing 3 outside the propeller 5 on either side of the propeller 5, to protect the propeller 5 from inflicting damage on persons or animals.

Figure 14:
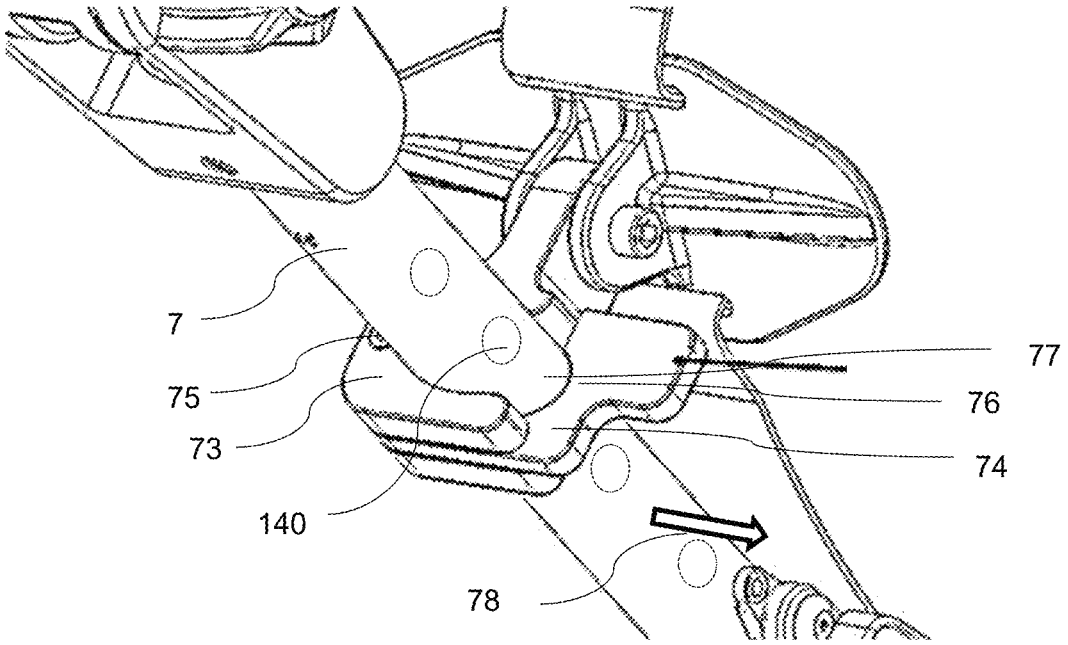

The backward open connector 73 may be provided with a further locking mechanism as indicated in the example given in FIG. 14 wherein a hook latch 74 pivotally connected in a pivot point 75 is provided and arranged such that an inner hook recess 76 is formed to fit the backward facing contour 77 of the rotatable arm 7. The hook latch 74 may be formed of a resilient material to ease the latching and unlatching operation of the hook latch 74. The hook recess 76 is formed to resist unlatching the hook latch 74 if a steady backward force 78 is applied to the rotatable arm 7, for example by the reverse operation of the motor. However, if the backward force 78 is abruptly applied to the rotatable arm 7, for example by a collision with an object, such as a stone on a lake or river bottom, the hook latch 74 may release its grip on the rotatable arm.

In even a further implementation of a hook latch it may be provided a more firm or solid latch locking the rotatable arm 7 into the backward connector 73. One option is to use a similar mechanism as shown for securing the controller shaft 17 above wherein clamp 21 is configured to secure the controller shaft 17 to the mounting bracket 19. A clamp knob 22 is configured to tighten an upper clamp part to a lower clamp part and thus rigidly fix the controller shaft 17, or any other part configured to be inserted into the clamp, to the mounting bracket 19. Other mechanisms may be chosen for solving the same purpose of resisting backward movement of the rotatable arm when motor is reversing.

Figure 15A:
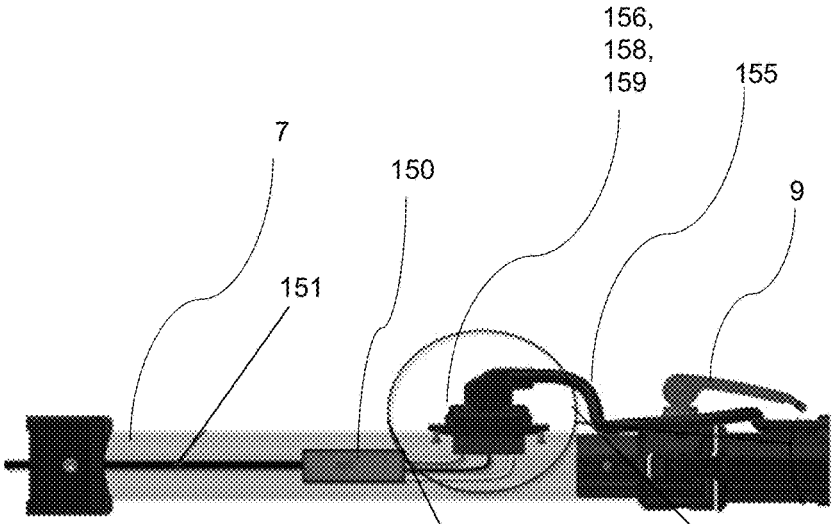
Figure 15B:
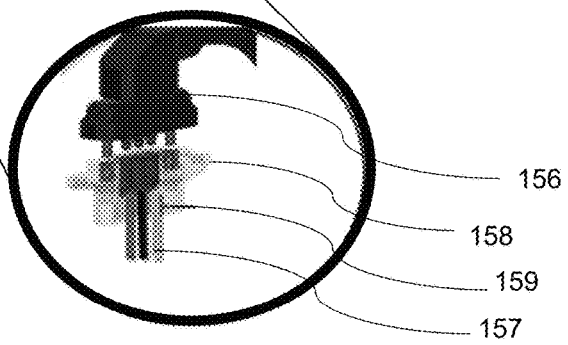

In a further embodiment of the motor assembly 1 controlling logic 150 for motor control is provided and arranged inside the rotatable arm 7 as exemplified in embodiment in FIGS. 15A and 15B. A wire bundle 151 comprising wiring for power from power source, and wiring for communication from controller unit 18 and power source 12. Further as illustrated; a connector lead through adapter 158 is arranged in the wall of the rotatable arm 7 for connecting cabling 157, 155 from the controller unit 18 and power source 12 via the controlling logic 150 and to the motor unit 23. The connecting points may be sealed off using a sealing/potting compound 159 to ensure a water resistant connection, and the controlling logic 150 may be embedded in a water tight encapsulation 150. Wiring for power connects the controlling logic with the power source and the motor unit 23. Signal communication between controlling logic and controller unit 18 may alternatively be provided by wireless communication means.

Although the chosen material of the various parts of the motor assembly 1 is a matter of designers choice, it is preferable to use lightweight materials having high stiffness and strength, such as aluminum, carbon fiber based materials or other.

The controlling logic may radiate considerable heat, and fro the logic this may be problematic unless properly cooled. Arranging the controller in a portion of the motor assembly which is in contact with water when operating enables the controlling logic 10 to use the water as a heat sink medium. When the controlling logic 150 is arranged in the rotatable arm 7, the rotatable arm 7 may in one embodiment be constructed of a hollow longitudinal arm, having draining holes in both peripheral ends to allow water to circulate inside the arm 7. When using materials with low thermal conductivity and the controlling logic being arranged inside, the rotatable arm 7 may be provided with more through holes 140 in the region of the arm 7 where the controlling logic is arranged inside, in order to increase the heat transfer from the controlling logic to the water outside the rotatable arm when the motor assembly 1 is in the active position.

In a further embodiment the controller unit 150 may be an integrated part of the motor unit 23.

Figure 16:
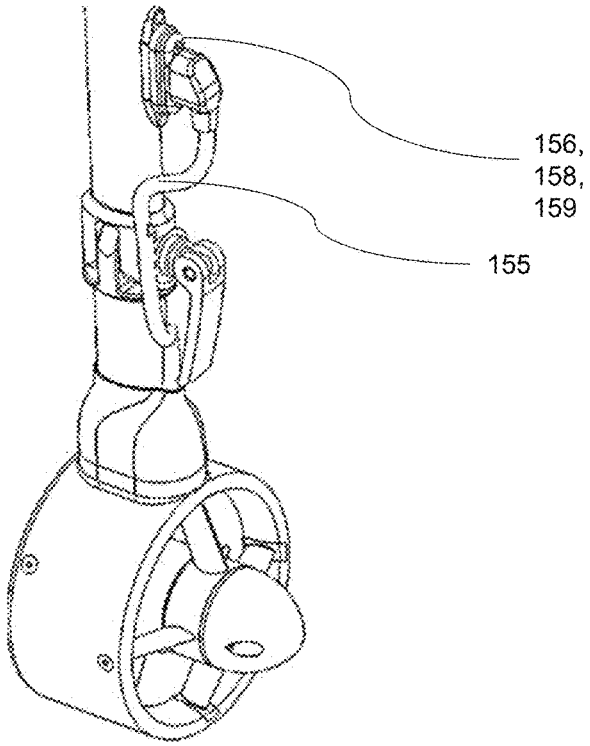

FIG. 16 show the lower part of the motor assembly when the controller unit 150 is embedded in the rotatable arm 7.

Figure 17A:
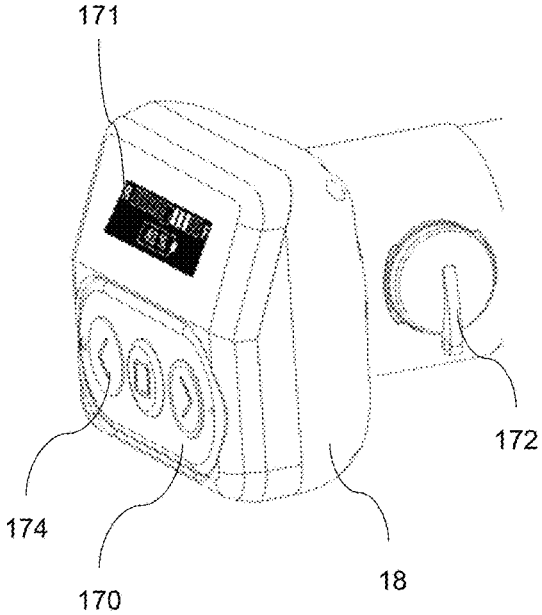
Figure 17B:
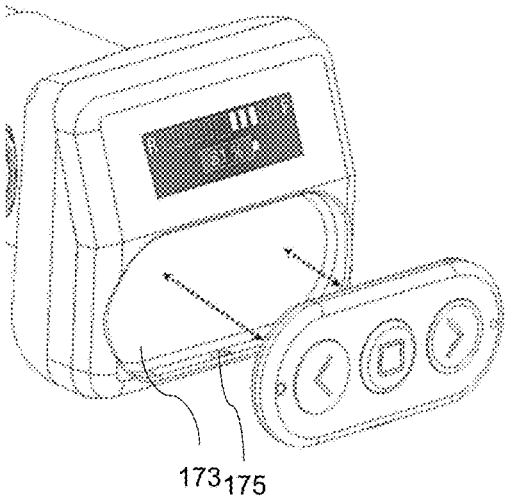

FIGS. 17A and 17B illustrates a further embodiment of the control unit 18 comprising a display unit 171 for displaying for example power left in power source, and speed forward/reverse, an emergency stop connector 172, and a remote controller 170 comprising for example buttons/touch sensitive sensors 174 for inputting control commands to the control unit. The remote controller may in one embodiment be embedded in the control unit 18 in a recess 173. The recess may be provided with holding devices 175 for retaining the remote controller when placed in the recess 173. Holding device may be a biased push button device, a magnetic device or other which cooperate with respective device provided in the remote controller (not shown). The remote controller may also be charged through its connection to the control unit, by wired charging or wireless inductive charging or other mechanism.

In an alternative use scenario, a water tight motor unit 23 may be used for underwater use, for example the unit can be folded together, and held by a swimmer/diver for pulling the person through the water.

FIG. 4 illustrates the bracket unit 24 isolated where the motor unit 23 is not mounted on the bracket unit 24. The mounting bracket 19 is shown with the support belt 16 connected at two generally opposite sides. The support belt 16 is tightened and kept in a tightened position by buckles 30. The support 20 and clamp 21 is illustrated in one alternative embodiment for providing support to the embodiment of the motor unit 23 in the figures. The aim is to provide a firm support for the motor 23 when the motor 23 is mounted to a kayak. It is within the scope of the invention to choose other connection designs providing firm attachment of the motor to the kayak. The attachment means may even be attached directly to the body of the kayak, or even be an integrated part of the body of the kayak.

Figure 2B:
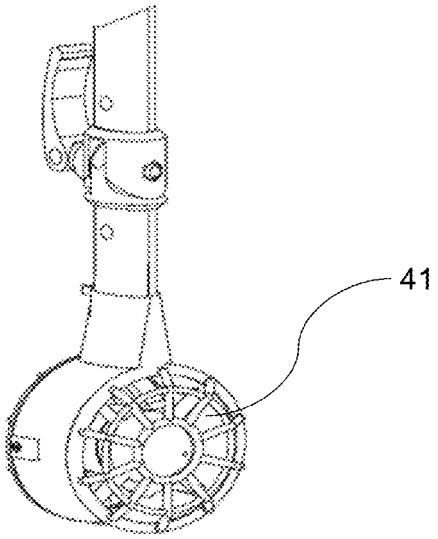
FIG. 2B—close-up of propeller casing viewed from behind with protective mesh FIG. 2C—close-up of propeller casing viewed from front with protective mesh FIG. 3—motor assembly close-up unmounted and without battery and controller casing FIG. 4—mounting bracket and support belt, oblique view FIG. 5—section of kayak and motor assembly seen from below FIG. 6—on board remote controller FIG. 7—section of kayak and motor assembly folded in an inactive position FIG. 8—rear view of kayak and motor assembly folded in an inactive position FIG. 9—motor assembly in a straight configuration FIG. 10A—straight configuration motor assembly attached to a dinghy, bottom view FIG. 10B—detail straight configuration motor assembly attached to a dinghy, top view FIG. 11A-A first exploded side view of the linkage arm FIG. 11B-A second exploded side view of the linkage arm FIGS. 12A and B—Embodiment of snap-connection without and with rotatable arm arranged FIG. 13—System configured with cloud/wide area network FIG. 14 Locking mechanism FIG. 15A-15B—Controlling logic in rotatable arm FIG. 16—rotatable arm comprising controlling logic FIG. 17A-17B—Control unit and remote controller
Figure 2C:
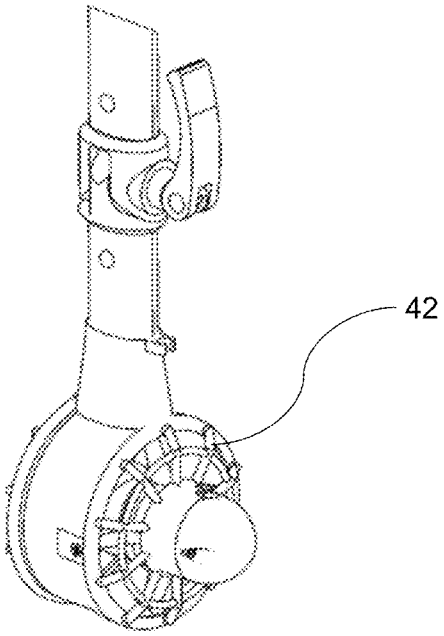
Figure 5:
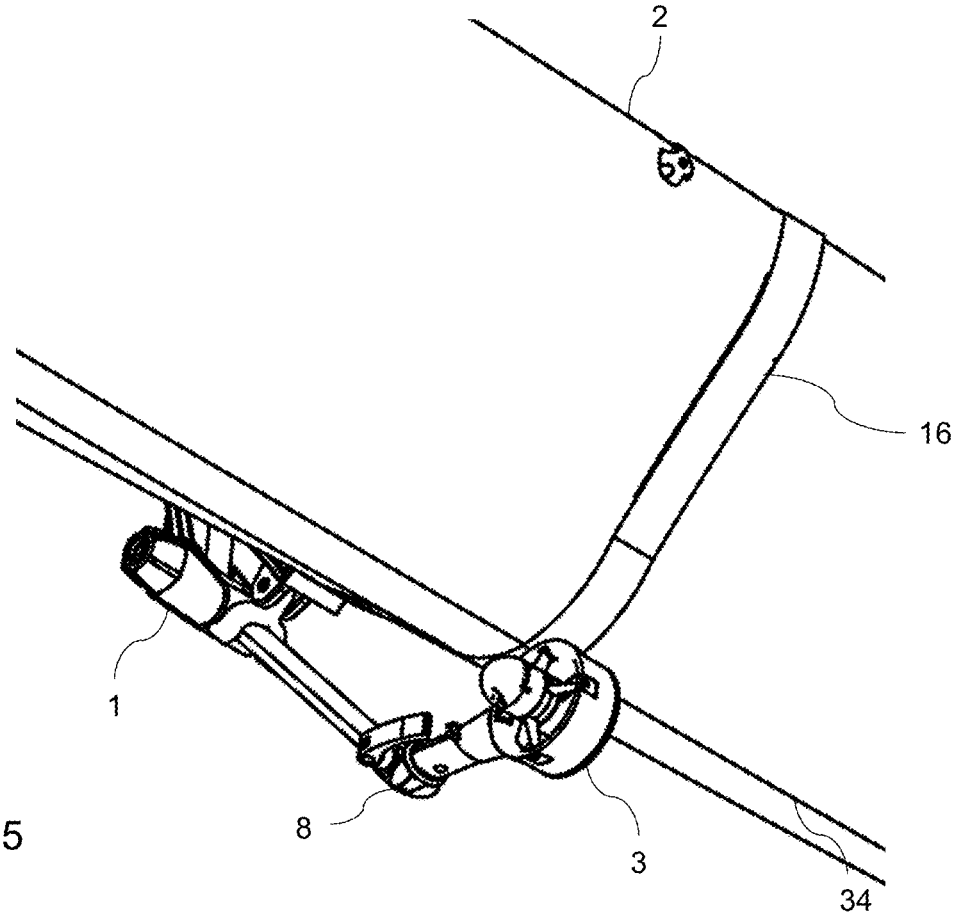
Figure 6:
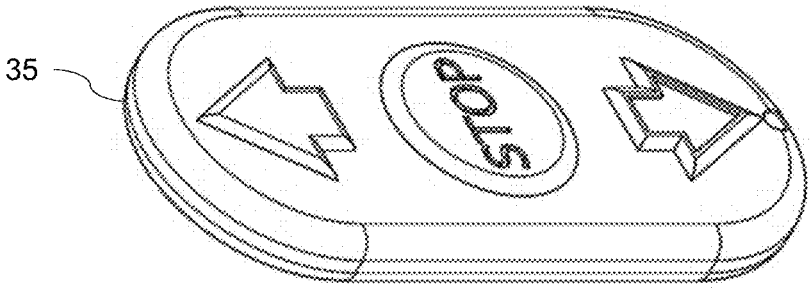

FIG. 5 illustrates the position of the propeller housing 3 when in the active position. The propeller housing 3 is positioned generally in the middle of the kayak, below the keel 34. In FIG. 5, the support belt 16 is also visible, spanning across the underside of the kayak 2. The motor assembly 1 is configured such that if the propeller housing 3 collides with a rock or similar sea bed formation, i.e. the vessel is grounding, the propeller housing 3, propeller housing arm 6 and rotatable arm 7 can flex or rotate in a backward manner, such as to prevent severe damage to the motor assembly 1 and prevent a hazardous, immediate halt of the vessel. The propeller housing pivot connection point 8 (explained previously with reference to FIG. 2) could be adapted to flex or rotate in a backward manner, e.g. if the propeller housing 3 meets an obstacle. Similarly, the linkage arm pivot connection point 11 between the battery housing 12 and the linkage arm 10 could be adapted to flex or pivot such that the rotatable arm 7 moves if the propeller housing 3 or rotatable arm 7 meets an obstacle.

A remote communication/controller unit 35 may be provided for communicating with the controller unit 18. The remote controller may communicate over a wireless communication link, and thus provide a feature for remote controlling the propulsion of the kayak. This is specifically appropriate if the motor assembly 1 is mounted behind the person, or if the motor assembly 1 is used on a paddle board where the user stands up and is not able to easily reach the controller switches and knobs.

Figure 8:
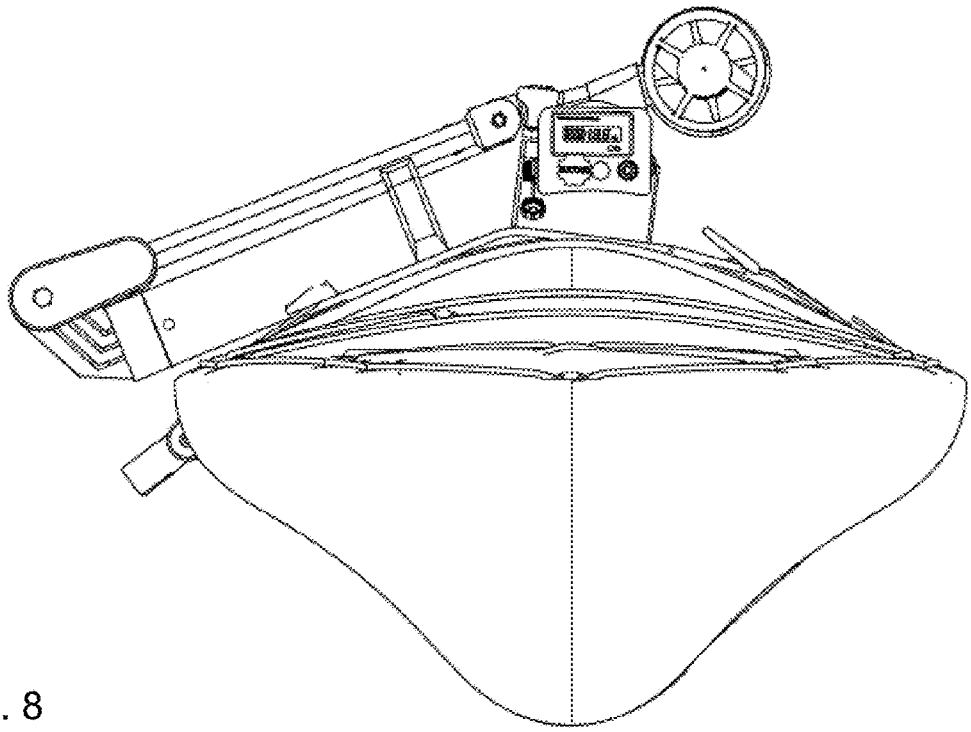

FIGS. 7 and 8 illustrates a motor assembly 1 mounted on a kayak 2. In FIG. 7, the propeller housing 3 of the motor assembly 1 is in an in-active position, i.e. the propeller housing 3 and the rotatable arm 7 are folded on top of the mounting bracket 19 and the kayak 2. The rotatable arm 7 is resting on top of the battery housing 12, and the linkage arm knob 11 is tightened such as to secure the inactive position of the rotatable arm 7. In the inactive position the propeller housing arm 6 is generally parallel with the battery housing 12. The propeller housing arm 6 can be rigidly fixed in this position by utilizing the lock handle 9.

Figure 9:
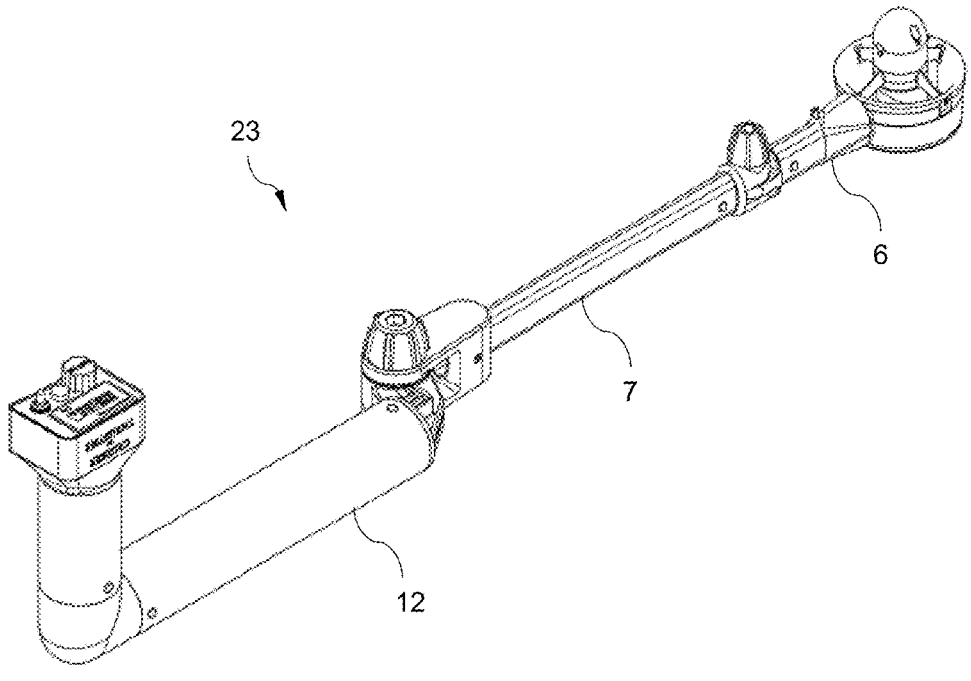
Figure 10A:
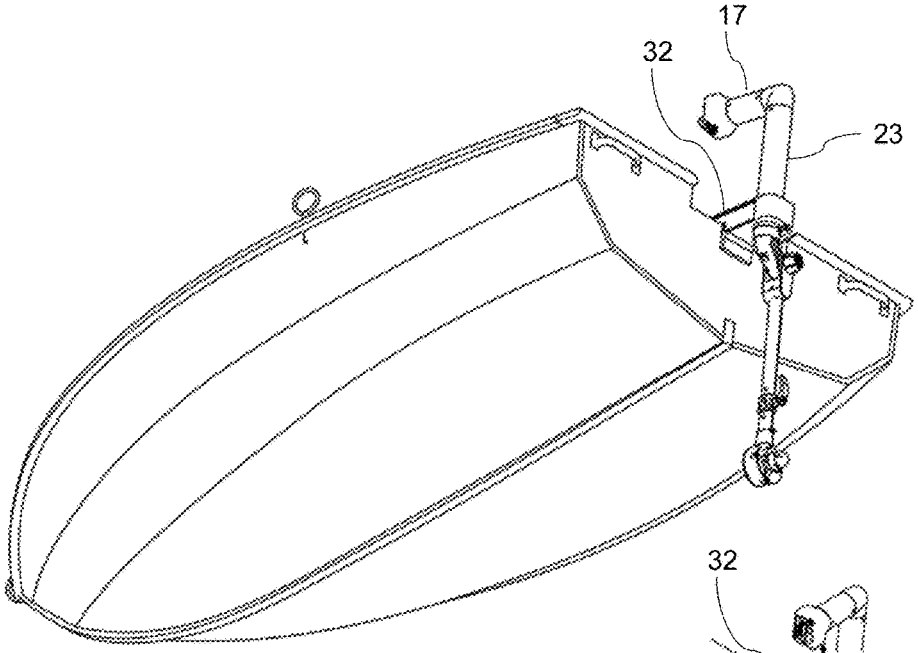
Figure 10B:
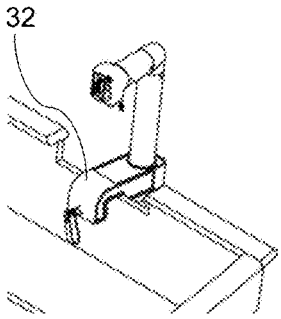

FIGS. 9, 10A and 10B illustrate an alternative use of the motor unit 23, in a straight configuration for use as a removable motor on a dinghy or similar small vessel. Mounting on such a marine vessel is different than on a kayak and similar, and the motor unit 23 can be adapted to such use. In the straight configuration, the battery housing 12, rotatable arm 7 and propeller housing arm 6 are arranged in a lengthwise parallel configuration as illustrated in FIG. 9. The motor unit 23 may be adapted to be mounted at the rear of a dinghy or similar vessel, where the motor of such vessels is commonly attached. A mounting bracket 32 which is configured for fast and reliable fixing the motor unit 23 to the dinghy can be provided. This mounting bracket 32 also comprises a rotatable bearing, allowing easy maneuvering of the motor unit 23. In this configuration, the controller shaft 17 functions as a control stick, allowing a user to control and maneuver the motor unit 23 similarly to other outboard motors. The mounting bracket 32 can also be adapted to be mounted e.g. on the side of a canoe.

Figure 13:
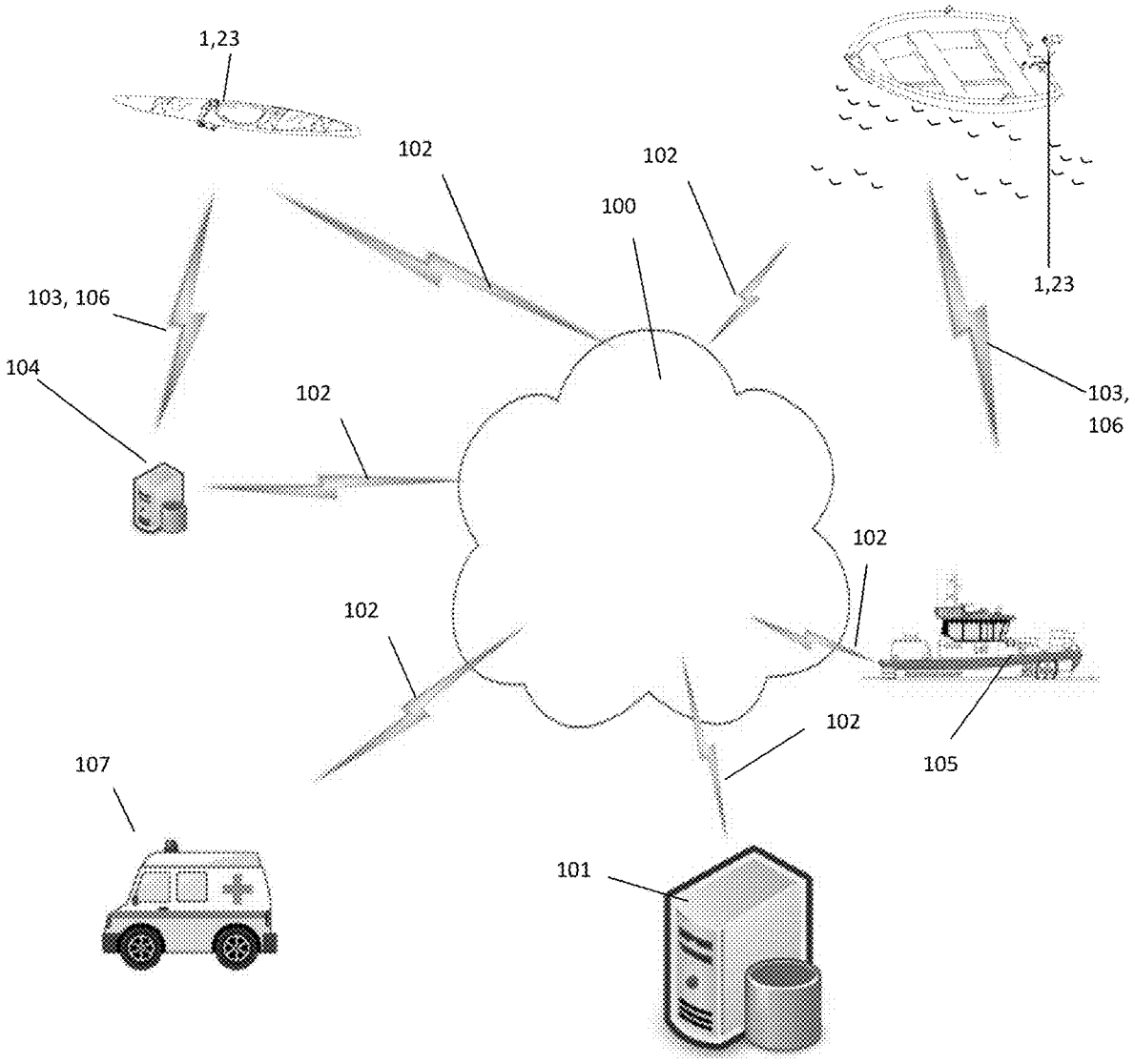

FIG. 13 illustrates a system embodiment of the invention wherein the controller unit 18 comprises a wireless communication unit able to communicate a beacon 106 searchable by a searching party 105. The wireless communication unit may also be able to communicate 103 audio and other information to and from the motor unit 23 for example for the searching party to be able to take intelligent decisions, such as send for emergency transport 107 or communicate with persons in distress. The communication unit may further be able to communicate with a cloud or wide area network 100, and through this communicate 102 with a server service 101, the searching teams 105, the transport 107 or a local alarm station 104. This can typically be an emergency service able to react to distress signals, and which may communicate 102 with appropriate control rescue teams 105 and emergency transportation 107. Other cloud services may comprise social network reporting and communication, or session log features.

Communication transfer medium 102, 103, 106 may be one of, wireless LAN or WAN, Bluetooth, WIFI, mobile network, radio communication, or other communication medium.

A further system feature may comprise a local alarm station 104 provided on site, for example at selected water sport facilities. Each invention device 1, 23 may at preset intervals communicate 103 with a local alarm station 104 to identify presence and no-distress signal. When an emergency situation is detected, the local alarm station 104 may be programmed to provide a list of persons out of danger, and who's in a danger.

A system according to present invention may comprise other lifesaving equipment that can be remotely or automatically be activated. Such lifesaving means may be inflatable buoy, flare, sound signal or other.

While the invention has been described with reference to the embodiment(s) mentioned above, it is to be understood that modifications and variations can be made without departing from the scope of the present invention, and such modifications and variations shall remain within the field and scope of the invention.

The invention can further be defined by a first embodiment of a motor assembly (1) for providing propulsion of a floating vessel, comprising:

motor device (23), mounting means (24, 32) for attaching the motor device (23) to the floating vessel, the motor device (23) comprising an electrical motor (4) and a propeller (5) arrange inside a propeller house (3).

The invention can further be defined by a second embodiment of a motor assembly (1) according to the first embodiment of a motor assembly, wherein the motor device (23) further comprise a propeller housing arm (6), a rotatable arm (7), and a battery and controlling unit (12, 17, 18), wherein the propeller housing arm (6) connects the propeller house (3) to the rotatable arm (7), and the rotatable arm (7) connects the propeller housing arm (6) to the battery and controlling unit (12, 17, 18).

The invention can further be defined by a third embodiment of a motor assembly (1) according to the any of the first to second embodiment of a motor assembly, wherein one or more of the housing arm (6), the rotatable arm (7), and the battery and controlling unit (12, 17, 18), comprise pivot connection points (8, 11, 36) between them for facilitation of folding in and folding out the motor assembly (1).

The invention can further be defined by a fourth embodiment of a motor assembly (1) according to the third embodiment of a motor assembly, wherein the one or more pivot connection points (8, 11, 36) comprise lock and release devices (9, 11, 15).

The invention can further be defined by a fifth embodiment of a motor assembly (1) according to the any of the second to fourth embodiment of a motor assembly, wherein the controlling unit (12, 17, 18) is comprised of a battery housing (12), a controller shaft (17) and a control unit (18).

The invention can further be defined by a sixth embodiment of a motor assembly (1) according to the fifth embodiment of a motor assembly, wherein a connection point (37, 38) between one or more of the battery housing (12), the controller shaft (17) and the control unit (18) is a pivotal and/or angled connection point.

The invention can further be defined by a seventh embodiment of a motor assembly (1) according to the any of the first to sixth embodiment of a motor assembly, wherein one or two protective mesh (41, 42) is arranged on one or both side of propeller (5) and is fastened to the propeller housing (3).

The invention can further be defined by an eight embodiment of a motor assembly (1) according to the any of the third to seventh embodiment of a motor assembly, wherein the control unit (18) comprise one or more of a display unit (33), a communication unit, a power charging connector (26), a power switch (29), an emergency stop connector, an audio in/out unit, a navigation unit, a temperature sensor, a power regulating switch (27), and a speed indicator.

The invention can further be defined by a ninth embodiment of a motor assembly (1) according to the any of the first to eight embodiment of a motor assembly, wherein the motor device (23) is water tight for functioning under water.

The invention can further be defined by a tenth embodiment of a motor assembly (1) according to the any of the first to ninth embodiment of a motor assembly, wherein the propeller housing arm (6) and the rotatable arm (7) has a foil or oval form to provide minimum drag when being submerged in water.

The invention can further be defined by an eleventh embodiment of a motor assembly (1) according to the any of the first to tenth embodiment of a motor assembly, wherein the control unit (18) further comprising a communication device, the communication device being able to transmit operation status to a remote communication unit (101, 104, 105, 107).

The invention can further be defined by a twelfth embodiment of a motor assembly (1) according to the any of the first to eleventh embodiment of a motor assembly, wherein the communication device being able to receive operation instructions from a remote communication unit (35, 101, 104, 105, 107).

The invention can further be defined by a first system embodiment for providing propulsion of a floating vessel, wherein the system comprises one or more devices (1, 23) according to any of the eleventh or twelfth embodiment of a motor assembly (1), the system further comprise a remote communication unit (35, 101, 104, 105, 107), and a communication transfer medium 102, 103, 106).

The invention can further be defined by a second system embodiment according to the first system embodiment for providing propulsion of a floating vessel, wherein the remote communication unit (101, 104, 105, 107) is one of local alarm station (104) able to identify presence and no-distress signal of the devices (1, 23), remote server (101) able to monitor and communicate with other remote communication units (101, 104, 105, 107), search party (105) able to locate device (10, 20) merely by receiving a beacon (106) broadcasted by a device (1, 23), or an emergency transport (107).

The invention can further be defined by a third system embodiment according to the first or second system embodiment for providing propulsion of a floating vessel, wherein the devices (1, 23) is further combined with other lifesaving equipment.

What is claimed is:

1. A motor assembly for providing propulsion of a floating vessel comprising:

a motor device wherein the motor device comprises:
- an electrical motor,
- a propeller arranged inside a propeller house,
- a rotatable arm, and
- a battery and controlling unit, and a mount for attaching the motor device to the floating vessel, wherein:

the motor device is detachably mounted to the mount, the propeller house is connected to the rotatable arm, and the rotatable arm connects the propeller house to the battery and controlling unit, a controlling logic for motor control is provided and arranged inside the rotatable arm and electrically connected to the battery and controlling unit on one side and to the motor device on the other side, and the motor device further comprise:
- a first active position in which the propeller housing is arranged under the floating vessel, and
- a second inactive position in which the propeller housing is arranged in a resting position, and the rotatable arm is pivotally connected to the battery and controlling unit in a manner allowing a complete folding and unfolding of the rotatable arm between the first inactive position and the second inactive position, such that when the motor device is folded in the second inactive position the rotatable arm can be positioned in a generally parallel position relative the battery and controlling unit.

2. The motor assembly according to claim 1, wherein the motor device further comprises a propeller housing arm, wherein the propeller housing arm connects the propeller house to the rotatable arm.

3. The motor assembly according to claim 1, wherein one or more of the housing arm, the rotatable arm, and the battery and controlling unit, comprise pivot connection points between them for facilitation of folding in and folding out the motor assembly.

4. The motor assembly according to claim 3, wherein the one or more pivot connection points comprise lock and release devices.

5. The motor assembly according to claim 3, wherein the controlling unit is comprised of a battery housing, a controller shaft and a control unit.

6. The motor assembly according to claim 5, wherein a connection point between one or more of the battery housing, the controller shaft and the control unit is a pivotal and/or angled connection point.

7. The motor assembly according to claim 1, wherein one or two protective mesh is arranged on one or both side of propeller and is fastened to the propeller housing.

8. The motor assembly according to claim 3, wherein the control unit comprise one or more of a display unit, a communication unit, a power charging connector, a power switch, an emergency stop connector, an audio in/out unit, a navigation unit, a temperature sensor, a power regulating switch, and a speed indicator.

9. The motor assembly according to claim 1, wherein the motor device is water tight for functioning under water.

10. The motor assembly according to claim 1, wherein the propeller housing arm and the rotatable arm has a foil or oval form to provide minimum drag when being submerged in water.

11. The motor assembly according to claim 1, wherein the control unit further comprising a communication device, the communication device being able to transmit operation status to a remote communication unit.

12. The motor assembly according to claim 1, wherein the communication device being able to receive operation instructions from a remote communication unit.

13. A system for providing propulsion of a floating vessel, wherein the system comprises one or more devices according to claim 11, the system further comprise a remote communication unit, and a communication transfer medium.

14. The system according to claim 13, wherein the remote communication unit is one of local alarm station able to identify presence and no-distress signal of the device, remote server able to monitor and communicate with other remote communication units, search party able to locate device merely by receiving a beacon broadcasted by a device, or an emergency transport.

15. The system according to claim 13, wherein the devices is further combined with other lifesaving equipment.

16. A system for providing propulsion of a floating vessel, wherein the system comprises one or more devices according to claim 12, the system further comprise a remote communication unit, and a communication transfer medium.

17. The system according to claim 16, wherein the remote communication unit is one of local alarm station able to identify presence and no-distress signal of the devices, remote server able to monitor and communicate with other remote communication units, search party able to locate device merely by receiving a beacon broadcasted by a device, or an emergency transport.

18. The system according to claim 16, wherein the devices is further combined with other lifesaving equipment.

* * * * *